US005502551A

United States Patent [19]

Bonino et al.

[11] Patent Number: 5,502,551

[45] Date of Patent: Mar. 26, 1996

[54] TONING SHOE EMPLOYING A BIFURCATED RETURN PORT

[75] Inventors: Richard J. Bonino, Menlo Park; Gene F. Day, Hillsborough, both of Calif.

[73] Assignee: Phoenix Precision Graphics, Inc., Sunnyvale, Calif.

[21] Appl. No.: 453,388

[22] Filed: May 30, 1995

[51] Int. Cl.[6] ..... G03G 15/10

[52] U.S. Cl. ..... 355/256; 118/660

[58] Field of Search ..... 355/256; 118/659, 118/660

[56] References Cited

U.S. PATENT DOCUMENTS 5,231,455 7/1993 Day ..... 355/256
5,268,721 12/1993 Day ..... 355/256
5,296,645 3/1994 Zwadlo et al. ..... 355/256
5,296,899 3/1994 Day ..... 355/256

*Primary Examiner*—Joan Pendegrass
*Assistant Examiner*—Quana Grainger
*Attorney, Agent, or Firm*—Schneck & McHugh

[57] ABSTRACT

An electrostatic recorder or copier having a toning shoe that includes a plurality of fluid supply channels in a bifurcation means for separating fluids, to avoid back pressure in the toning shoe. The bifurcation means substantially separates a flow of return air from a flow of return toner in the toning shoe by defining a plurality of fluid return channels. The electrostatic recorder or copier also includes a backing support spaced apart from the applicator so as to flexibly retain a recording medium in close proximity to a toning surface of the toning shoe.

11 Claims, 2 Drawing Sheets

TONING SHOE EMPLOYING A BIFURCATED RETURN PORT

TECHNICAL FIELD

The present invention pertains to the field of color printing. Specifically, the present invention pertains to an electrostatic color printer or copier.

BACKGROUND ART

Electrostatic printers and copiers commonly use an electrostatic writing head to form a latent image of electrical charges onto a recording medium such as a flexible paper web. The paper web, carrying the latent image, is then directed to a liquid toning applicator which deposits oppositely charged toner particles onto the paper web, thereby developing the latent image.

Generally, there are two designs for liquid toning applicators, vacuum-type or pressure-type. The vacuum-type applicators employ a liquid pump to draw toner from a reservoir into and through one or more channels located in the face of the applicator to come into contact with the flexible paper web. The web's flexibility serves to seal the face of the applicator thus permitting the pump to create a vacuum in the channels. The vacuum draws toner into and through the channels. The outlet of the toner pump returns the spent toner to the reservoir. In this manner, a continuous recirculation of the toner occurs.

Despite the inherent advantage of leak protection, suction-type applicators have limited application. These applicators are plagued by slow toning speeds that result from the paper web coming into contact with the toner via small channels. The channels must be very small to prevent the paper web from being pulled down into them. As the speed of the web passing over the applicator is increased, additional channels are required which leads to increased sliding friction, a phenomena sought to be avoided. Moreover, narrow channels require a greater vacuum to maintain toner flow. This also increases sliding friction by adding to the downward force on the paper web. In addition, this design is unsuitable for creating pictorial images.

The speed and image quality limitations of vacuum-type applicators brought about the first pressure-type toning applicator, in which a wetted roller is rotated against the latent image bearing sheet. A scraper blade removes the excess spent toner from the roller prior to re-wetting with toner and again contacting the image. This method provides uniform toning as well as very low sliding friction. The toner cascading down the scraper blade flows in an unconstrained or uncontained manner and has to be collected with a full-width funnel or gutter, similar to collecting rainwater by a roof gutter. This gutter is hard to clean by simple rinsing compared to the small vacuum slits of the previous art.

The small slits of the vacuum system can be scoured by simply passing clean fluid through them at high speed. With the roller system, running clear fluid through the toning system can effect cleaning but it is very slow, in fact, too slow to permit a single applicator to be used for multiple colors. Thus, with prior art toning methods, both vacuum and pressure, it is not possible to achieve high quality and high toning speed in a cleanable toning system. Therefore, it is not possible to achieve the cost advantages of a single applicator design in a high speed, high quality printer. This fact led to the development of another type of pressure toning system, namely the positive air-pressure design. This new design permits high quality and speed in a readily cleanable system.

The positive air-pressure system, described in U.S. Pat. No. 5,268,721 to Day, assigned to the assignee of the present invention, uses pressurized air to confine the toner rather than suction. This permits the toner to be pumped through the channels of an applicator rather than drawn through by suction. The web is not drawn tightly against the face of the applicator and high friction is avoided. Furthermore, the toner flow is totally contained and high speed cleaning is possible in contrast to the open-flow of the roller system. Since there is no suction, the channels facing the web can be arbitrarily large and this permits high speed toning as well.

As disclosed in U.S. Pat. No. 5,268,721 a pressurized air channel completely surrounds the wet area of the applicator. The fact that the air pressure is higher than the fluid pressure assures that toner cannot escape against the higher air pressure. In the prior vacuum system, ambient or room air pressure is higher than the liquid pressure and leakage is prevented. Since the toner is confined in the positive air-pressure applicator, no funnel or gutter is needed and high speed cleaning is possible. A planar backing member behind the paper web, i.e. on the other side of the web, is used to keep the web flat against the applicator face.

U.S. Pat. No. 5,296,899 to Day, also assigned to the assignee of the present invention, discloses a positive air-pressure applicator with a segmented backplate which flexibly retains the paper web in close proximity to the surface of the applicator so that excess air does not leak from between the applicator surface and the paper web. In one embodiment, a backing plate segment is elastically supported by a cross member via a compressed spring. In an alternate embodiment, a leaf spring is riveted to the cross member and supports the backing plate segment. The backing plate is formed from a plurality of segments. Each segment is independently supported by the cross member via a compressed spring. In this manner, the backing plate may conform to the irregularities in the surface of the applicator and, thereby, avoid excess air leakage.

U.S. Pat. No. 5,231,455 to Day discloses a method and apparatus for reducing the effective common volume of an applicator that is shared with a plurality of reservoirs containing toners of different colors. A pump is employed for applying toner to the paper web and washing. An air-blower is employed to purge the applicator of toner.

A problem encountered with the aforementioned inventions is the leakage of toner around edges of the applicator, as well as a loss of air pressure.

An object of the present invention is to provide a graphics quality applicator that is capable of maintaining stable air pressure while avoiding toner leakage during operation.

SUMMARY OF THE INVENTION

This object has been achieved by providing an electrostatic recorder or copier having a toning shoe that includes a plurality of fluid supply channels and a bifurcation means for separating fluids, with the bifurcation means defining a plurality of fluid return channels. This arrangement is based upon the discovery that concurrently flowing return air and return toner through a common channel of the toning shoe causes back pressure in said channel. To avoid the back pressure, a bifurcation means is employed which substantially separates a flow of return air from a flow of return toner in the toning shoe. The electrostatic recorder or copier also includes a backing support spaced apart from the toning shoe so as to flexibly retain a recording medium in close proximity to a toning surface of the toning shoe. In this fashion, excess air is prevented from leaking between a toning surface of the toning shoe and the recording medium. In a preferred embodiment a vise means for providing a variable clamping force to the recording medium is provided so that recording medium may be squeezed between the applicator and the back plate. The vise means is typically an expandable bladder that expands or retracts in response to fluid pressure from a fluid pressure source. A cross member is provided that is spaced apart from the toning shoe. An adhesive attaches a bladder to the cross member. The bladder includes a metal surface, facing the applicator, capable of conforming to the irregularities of the toning surface. The metal surface may be connected as an electrically grounded electrode. In another embodiment, the metal surface is a thin single sheet of metal that may have a surface area at least as large as the surface area of the toning surface. An alternate embodiment, the metal surface includes a plurality of metal sheets or plates that may have a combined surface area at least as large as the surface area of the toning surface.

BEST MODE FOR CARRYING OUT THE INVENTION

Figure 1:
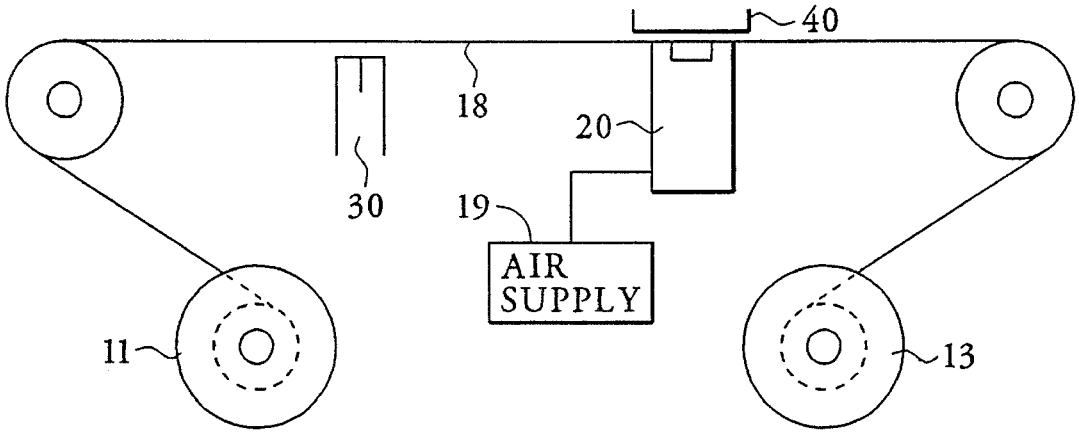
FIG. 1 is a simplified schematic view of an electrostatic printing and copying apparatus utilizing a toning shoe in accord with the present invention.

Referring to FIG. 1, an electrostatic printing and copying system is shown in accord with the present invention. Paper supply roller 11 and take-up roller 13 accurately position a recording medium, such as paper web 18, and maintain tension in the web 18. The toning shoe 20 spans the width of paper 18. Liquid toner is supplied to the toning shoe 20 and flows across the entirety of a slightly recessed upper toning surface of a toning member. This forms a shallow channel which allows toner particles to adhere to charged regions of paper web 18. An electrostatic writing head 30 is located elsewhere in close proximity to the web. Head 30 has an array of closely spaced wires connected to a high voltage supply to deposit an electrostatic charge on the paper web, thereby writing a latent image. A backing support 40 resides above toning shoe 20, such that paper web 18 is disposed between the backing support 40 and the toning shoe 20.

Figure 2:
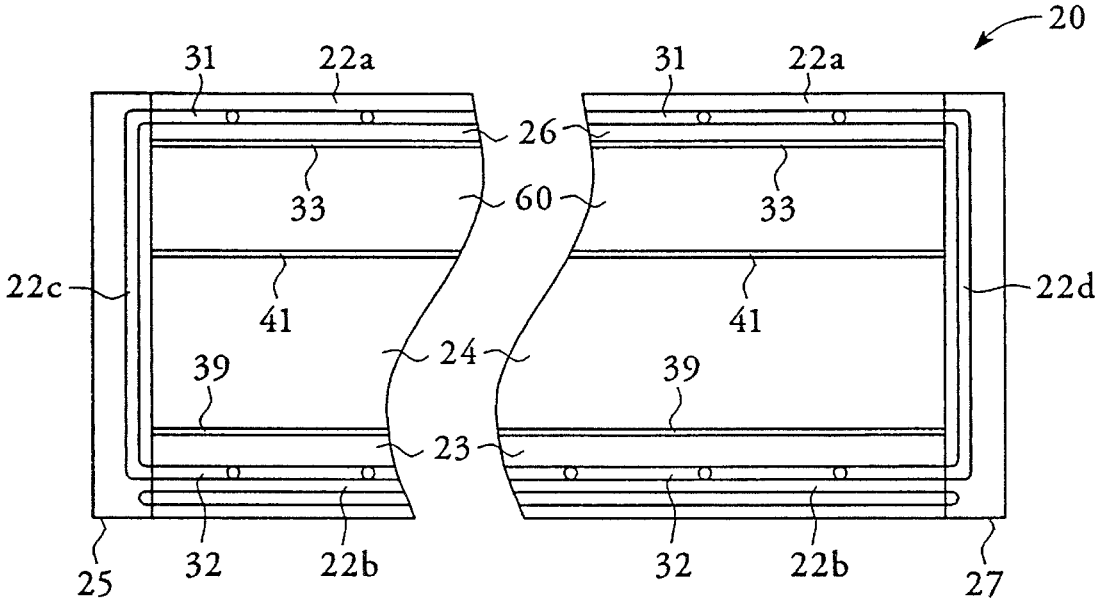
FIG. 2 is a top view of the toning shoe of FIG. 1 in accord with the present invention.
Figure 3:
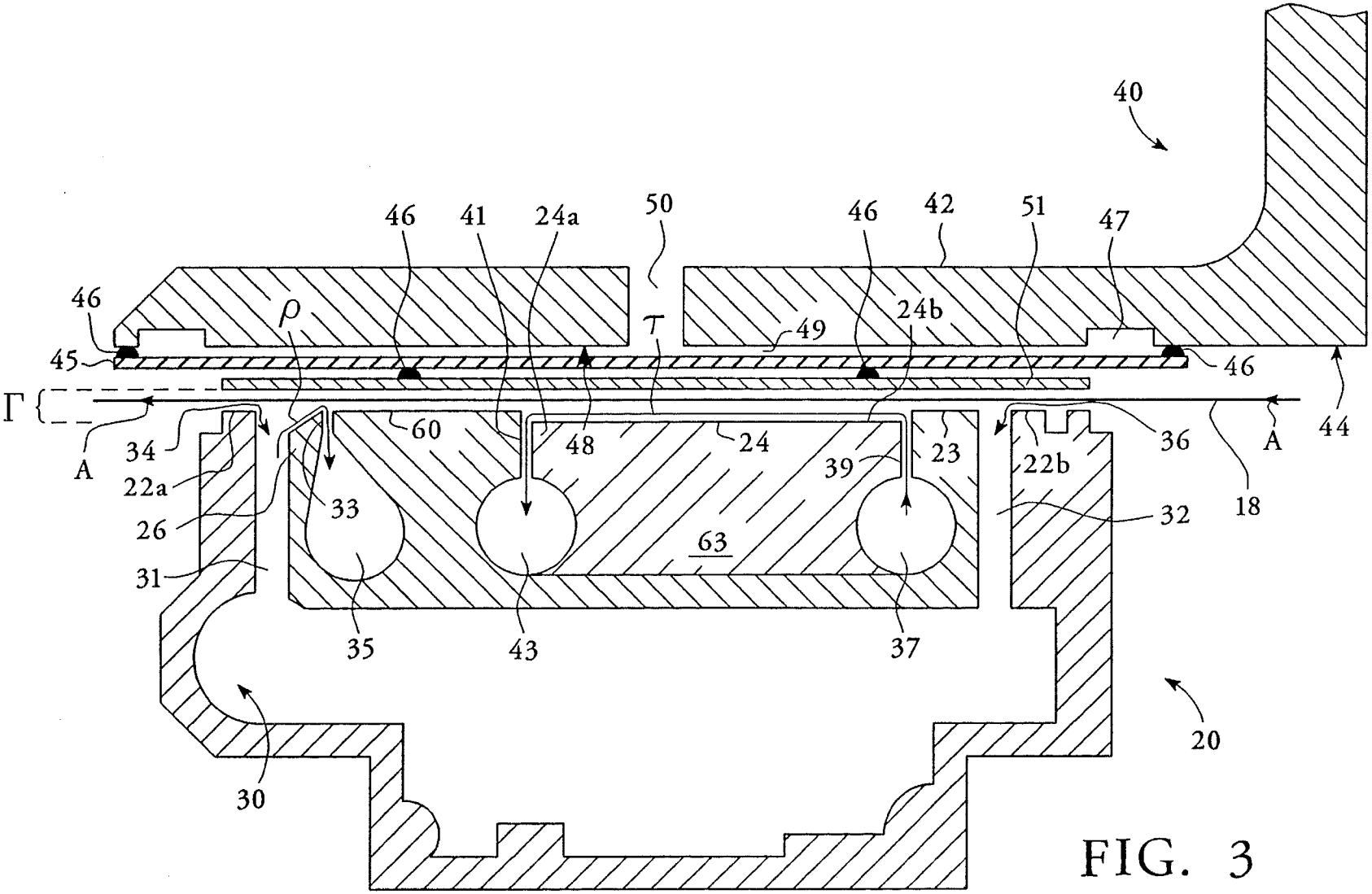
FIG. 3 is a cross-sectional side view of the toning shoe and backplate in accord with the present invention.

Referring to FIGS. 2 and 3, the toning shoe 20 effectively spans the entire width of paper web 18. Paper web 18 is typically 36 inches in width and moves along the direction indicated by arrows A. Toning shoe 20 has a toning member with a working surface 24. The working surface includes a first side 24*a* and a second side 24*b*, spaced apart from the first side 24*a*, with an elevated adjacent member 23 parallel to, and spaced apart from, the second side 24*b* of the working surface 24. The second side 24*b* of the working surface 24 and the adjacent member 23 are co-extensive, defining a toner supply slit 39 between them. Spaced apart from, and parallel to, the first side 24*a* of the working surface 24, is a bifurcation means 60. The bifurcation means 60 is coextensive with the first side 24*a* of the working surface 24 and a toner return slit 41 is defined between them. Spaced apart from, and parallel to, the bifurcation means 60 is an air knife 26. The air knife 26 is co-extensive with the bifurcation means 60 to define an air return channel 23 between them. Spaced apart from, and parallel to, the air knife 26 is a first peripheral member 22*a*. The first peripheral member 22*a* is co-extensive with the air knife 26 defining a first major fluid channel 31 therebetween. Spaced apart from, and parallel to the adjacent member 33, is a second peripheral member 22*b*. The second peripheral member 22*b* is co-extensive with the adjacent member 23 to define a second major fluid channel 32 therebetween.

The toning shoe 20 applies liquid toner across the entire width of web 18 except for small border regions at each edge. Typically, the toning member 24 is an electrode. Working surface 24 may be as much as 36 inches wide and have a length of ½ to 2 inches. Working surface 24 is recessed below surrounding border members 60 and 23 by 0.002 to 0.010 inch, more clearly shown in FIG. 3. Paper web 18 is controlled as it moves across the toning shoe 20 such that the entire image surface of web 18 has toner applied thereto via applicator 20. Air knife 26 removes excess toner from web 18 at the downstream edge of the toning shoe 20. Air egresses from the first and second major fluid channels 31 and 32 to confine liquid toner to working surface 24. The backing support 40 resides directly above the toning shoe 20, and is used to retain paper web 18 in close proximity to surface 24 such that air in major fluid channels 31 and 32 does not leak out excessively from between adjacent member and paper web 18.

Although toning shoe 20 is shown "free-standing", in practice, toning shoe 20 will be supported by a structure contained within the housing of a printer or copier. Pressurized air from an air supply means 19, as shown in FIG. 1, is supplied to airway 30. The pressurized air flows upward through major fluid channels 31 and 32 until it reaches upper peripheral members 22*a* and 22*b* of toning shoe 20. The air pressure at the topmost ends 34 and 36 of the major fluid channels 31 and 32 is greater than the liquid pressures along working surface 24 lying between topmost ends 34 and 36, so as to fully contain the toner and prevent leakage of the toner beyond the long edges of toning shoe 20. At the near and far ends of toning shoe 20, U-shaped channels or grooves 22*c* and 22*d*, open at the top, are provided in end caps 25 and 27 to attach to the upper peripheral members 22*a* and 22*b* of the ends of the toning shoe 20 in such a manner as to connect topmost ends 34 and 36 with each other at the near and far ends of the toning shoe 20. These two channels together with topmost ends 34 and 36 form a rectangular channel that surrounds the knife edge 26, bifurcation means 60, working surface 24 and adjacent member 23.

Air flowing to topmost end 34 crosses knife edge 33 and flows into the air return channel 35, as indicated by arrow ρ. A fitting (not shown) is connected at one end of the toning shoe 20 to collect spent air from the air return channel 35. Concurrent with the flow 10 of air, toner flows, under pressure, from the toner supply channel 37 through a supply slit 39, across toning surface 24, in a direction parallel to the web movement into toner return slit 41 and into the toner return channel 43, as indicated by arrow τ. In this manner, toning occurs in the gap between toning surface 24 and the web 18, while spent toner is collected by a fitting (not shown) connected at one end of the toner return channel 43. Typically, fresh toner is supplied at the same end of the toning shoe 20 at which spent toner is collected.

The air return channel 35, the toner return slit 41 and toner return channel 43 are defined by a bifurcation means 60 disposed within a void in the toning shoe 20. The bifurcation means 60 substantially separates return air flow from return toner flow. Having separate return channels for the toner and air provides the distinct advantage of overcoming back pressure in return channels 35 and 43. It was discovered that by concurrently flowing both return air and return toner into a common channel, a back pressure was created that resulted in the web 18 being pushed away from the toning surface 24.

Toner has a specific gravity 630 times greater than the specific gravity of air resulting in toner flow having a relatively small volume and a very large mass as compared to air flow. The differing physical characteristics between air and toner results in air flow having a much greater velocity than toner flow while both are subjected to a common pressure. When both air and toner concurrently flow through a common return channel, the channel tends to fill with toner, and the air presses against it. The heavier mass of the toner provides a resistive force to the air flow causing a back pressure in the common channel. The back pressure tends to lift contacting back plate 51, reducing the air pressure and causing toner leakage around the upper surfaces of the toning shoe 20. The combination of the above-identified problems causes undesirable image quality and toner spillage.

To avoid the back pressure, and the problems associated with it, the bifurcation means 60 is disposed in a common return port so as to provide two separate return channels: one return channel 35 for air and one return channel 43 for toner. With this structure 95% to 99% of spent toner passes into toner return channel 43. Although a small amount of spent toner may enter air return channel 35, the quantity present is insufficient to occlude that channel. Typically, both the air and the toner exiting the return channels enter an air/liquid separator tank (not shown). The toner collects on the bottom of the tank which the air collects in the portion of the tank above the toner. The toner flows into a purifier from a port in the bottom of the separator tank, while the air returns to an air pumping means through a port in the top of the separator tank.

Although not necessary, it is desirable to have the width of slit 41, as measured in a direction parallel to the web movement, more narrow than the toning gap, which is defined by the distance between working surface 24 and the web 18. This structure facilitates an air purge of the toning gap Γ to remove fluids therefrom, e.g., toner and wash fluid. Without completely purging fluids from the toning gap Γ, drying of the web 18 is made more difficult, resulting in wasted web material and an overall slowing of the print operation. For example, it was discovered that providing a slit 41 with a width greater than the width of the toning gap Γ caused toner to accumulate at the first side 24*a* of the working surface 24. Further, moving the web 18 in an attempt to force the accumulated toner into slit 41 is fruitless. The result is a residual wetness on the paper web 18, requiring moving a much larger segment of the web 18 across the air knife to effect drying of the web 18. As discussed above, to overcome the aforementioned problems, it is critical that the width of slit 41 is more narrow than the width of the toning gap Γ. The toning gap Γ may be in the range of 0.0040 to 0.0065 inch and the slit width may be in the range of 0.0030 to 0.0060 inch. However, in the preferred embodiment, the toning gap Γ is 0.0050 inch and the width of the slit 41 is 0.0040 inch.

Any backing support may be employed, including but not limited to, the backing supports disclosed in U.S. Pat. Nos. 5,268,721 and 5,296,899 to Day. It is preferred, however, that backing support 40 include a cross member 42 which is spaced-apart from the toning shoe 20. Typically, the cross member has a planar surface 44 facing the working surface 24 of the toning shoe 20. The surface area of the planar surface 44 is at least as large as the working surface 24 area of the toning shoe 20. In the preferred embodiment, the planar surface 44 and the toning shoe 20 are rectangular in shape. Attached to the planar surface 44 is an elastic bladder 45. The bladder 45 attaches along its periphery and typically has the same shape as the planar surface 44. Although the bladder 45 may be formed from any elastic material, typically it is made from a flat sheet of 0.015 inch thick neoprene or buna-N rubber. It is preferred to attach the bladder 45 using a cyanoacrylate adhesive 46. The planar surface 44 includes a groove 47 that follows the rectangular periphery of the bladder 45, defining an inner surface 48. The adhesive 46 is applied on the outside of the groove 47 so that an air-tight seal is formed between the bladder 45 and the planar surface 44. The groove 47, typically 1/16 inch deep and 1/4 inch wide, has sufficient dimensions to prevent wicking of the adhesive 46 inward into the inner surface 48. The bladder 45, adhesive 46, groove 47 and inner surface 48 define a chamber 49. Extending completely through the cross-member 42 into fluid communication with the chamber 49 is a through-hole 50. Excepting the through-hole 50, chamber 49 is air-tight.

Attached to the side of the bladder 45 opposite from the planar surface 44, is a thin metal sheet 51. Generally, metal sheet 51 is planar with a surface area at least as large as the toning shoe 20. It is preferred that metal sheet 51 is co-extensive with the surrounding peripheral members 22*a* and 22*b*, as well as the end caps 25 and 27 of the applicator. As with attaching the bladder 45 to the planar surface 44, the bladder is attached to sheet metal 51 with an adhesive 46. The adhesive 46 used to attach the sheet metal 51 is distantly positioned from the periphery of the bladder 45.

In operation, a fluid, typically air, is introduced into the chamber 49 via through-hole 50. The fluid-pressure present in the chamber 49 is application dependent. For example, while printing, the fluid-pressure in chamber 49 is sufficient to expand the bladder 45 so that the thin metal sheet 51 resides directly above toning shoe 20, to retain the paper web 18 in close proximity to surface 24. In this manner, air expelled from rectangular slit, as defined by channels 31, 32, 22*c* and 22*d*, does not leak out excessively from between peripheral members 22*a* and 22*b* and paper web 18. During a purge step, in which toner is expelled from the toning shoe 20, the fluid pressure in the chamber is sufficient to expand the bladder 45 so that it clamps the paper web 18 to the peripheral surfaces 22*a* and 22*b*. In this fashion, the bladder operates as a vise means with a variable clamping force. Preventing movement of the paper web 18 away from an upper surface of peripheral members 22*a* and 22*b* was necessitated to overcome pulsations resulting from liquid toner or clear dispersant passing through the applicator under air pressure used to purge it. It was recognized that the pulsations probably resulted from the clear dispersant encountering flow impedances, e.g., a corner, tube-fitting, a control valve or the like. The pulsations caused toner leakage around the paper web 18 during a purge step. To overcome this problem, an elastic bladder was employed. During the purge step, the paper web is pressed between the metal sheet 51 and the upper surfaces of peripheral members 22*a* and 22*b*, preventing its movement. During the toning step, the pressure between the metal sheet 51 and the toning shoe 20 can be varied by varying the pressure in the chamber 49. If the pressure in chamber 49 is reduced to zero, the metal sheet 51 may retract slightly from the back of the web.

Typically, the support cross member 40 is adjusted at zero pressure so that there is 0.005 to 0.025 inch of net "clearance" between the mating surfaces. Sheets of paper or other shim means may be used during printer set-up for this purpose. Such sheets of paper or other shim means are positioned on top of the working surface 24, then the cross-member-bladder-sheet metal assembly is rested on top of the peripheral members 22*a* and 22*b* and firmly clamped in that vertical position. Upon removal of the paper sheets or other shim means, the desired clearance is produced. At zero pressure the clearance may exist between web 18 and sheet metal 51 or it may exist between bladder 45 and the cross-member bottom surface 44. Which situation occurs depends on the weight of the sheet metal 51 and the stretch of the bladder 45. In the preferred embodiment the bladder is slack so that the weight of the sheet metal rests on the back of web 18. In the preferred embodiment, the fluid used to pressurize chamber 49 is air.

The periphery of the bladder 45 is attached to the planar surface 44 to facilitate expansion of the bladder toward the toning shoe 20. The groove 47 is provided to control the spread of the adhesive 46 so that the area of the bladder 45 actually bonded to the planar surface 44 is well defined. The adhesive 46 attaching the metal sheet 51 to the bladder 45 is distantly positioned from the periphery so that the metal sheet 51 will move uniformly to hold the paper web against toning shoe 20. Therefore, adhesive 46 is positioned proximate to the center of the metal sheet 51. In addition, the metal sheet 51 must be sufficiently pliable so that it may conform to slight irregularities of the toning member.

Figure 4:
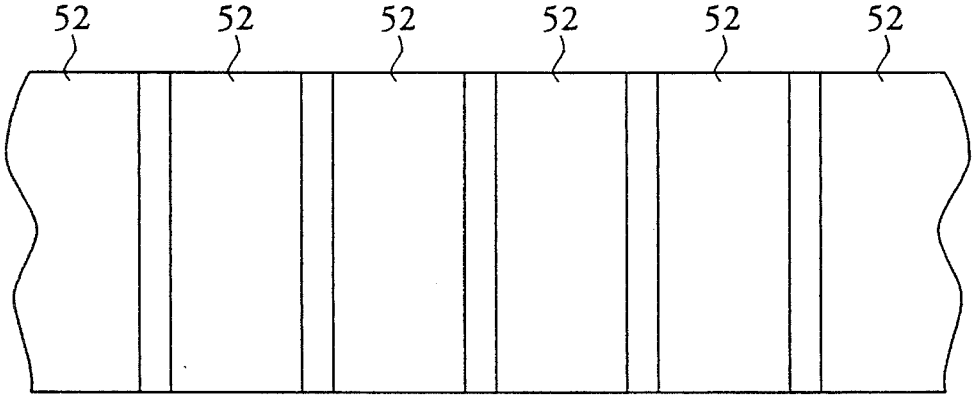
FIG. 4 is a bottom-up view of a plurality of metal sheets or plates attached to an expandable bladder.

To facilitate having the metal surface 51 conform to the working surface 24, the metal surface may comprise of a plurality of segmented metal sheets, as shown in FIG. 4. Each metal segment 52 is then independently attached to the bladder using an adhesive 46, as discussed above. Each of the metal segments 52 has a flat surface to bear against paper web 18. As with the single sheet of metal, the combined area of the flat surface is at least as large as the area of the peripheral members 22*a* and 22*b*, including end caps 25 and 27. Generally, each metal segment has a width of approximately ½ to 5 inches. Thus, by using multiple backing segments 52, paper web 18 may be held in close proximity to the toning shoe 20 along the entire length of the toning shoe 20. The metal segments 52 are attached closely together along cross member the bladder 45 such that no large gaps or wide spaces are present between them. Although metal segments 52 may be slightly separated from each other, the separation between segments is not large enough to allow paper web 18 to be lifted from the surface of the toning shoe 20. Typically, the gap between adjacent segments is 0.04 inch or less. In so doing, paper web 18 may be held at the desired position along the entire surface of the toning shoe 20 such that no excess air leaks from between the toning shoe 20 and web 18.

The plurality of metal segments conform very well to the irregularities in the peripheral members 22*a* and 22*b*, as well as working surface 24. In addition, by using several metal segments 52 having small contacting surfaces instead of a single larger thin metal sheet, the backing support 40 of the present invention may be formed using readily available mass-produced parts. Thus, the considerable expense of machining a single piece backing support precisely conforming to variations in the surface of the applicator is eliminated. Although metal segments 52 have a width of ½ to 5 inches in the preferred embodiment, the methods of the present invention are also suitable for backing segments having different dimensions and shapes. A preferred width is 3 inches.

It may be desirable, for instance, to have gaps between segments which are not parallel to the web advance direction. Such parallel gaps can, under some circumstances, lead to image artifacts. To this end the segments could be made in the shape of parallelograms or the like so that any imaging effects of the segment gaps might be avoided. The scope of this invention is intended to include segments of any shape which might be required to make images of arbitrary precision and quality. The segments can also consist of rigid plates rather than thin sheet metal. In one preferred embodiment, the segments consist of lapped aluminum plates which are 0.22 inch thick, 3 inches wide, and 3.5 inches long (in the web advance direction). By making the segments in this way and by reducing the 3-inch width to an arbitrarily smaller value, extremely precise fitting to the upper surfaces of peripheral members 22*a* and 22*b* may be effected even if the flatness of that applicator surface is somewhat irregular.

In addition to holding paper web 18 in place, the metal surface may also serve as a grounding electrode. As an electrostatic writing head deposits an electrostatic image onto one side of web 18, it is necessary to continuously remove electrical charge from the opposite side of web 18 in order to prevent a strong negative potential from appearing in the portion of the web undergoing toning. Such a strong negative potential can cause severe fogging or staining of the image. The metal surface attached to bladder 45 may serve as an especially effective grounding electrode and is thus very effective in preventing unwanted fogging and staining of the toned image.

In addition to the above electrical benefit, it is desirable to maintain the web 18 near electrical ground potential for other reasons. Even if no latent image formation is taking place (no writing), the act of toning itself produces electrical currents which can cause the web to acquire a positive electrical potential. Such a positive electrical potential does not normally cause fogging or staining as does a negative potential, but it can strongly inhibit the toning process from completely taking place. The same effective electrical grounding enabled by the metal surface also enhances the toning process itself and renders it more effective. This not only produces enhanced colors but reduces "residual potential" problems which typically cause color impurities in the finished print.

We claim:

1. A toning shoe for an electrostatic recorder or copier comprising:

a toning member having a toning surface positioned to face a recording medium having a first major surface bearing a latent image and an opposed second major surface, said toning member having a first side and a second side, spaced apart from and parallel to said first side, an adjacent member, proximate to and spaced apart from said first side, defining a fluid applicator port therebetween;

a knife edge, positioned proximate to said second side, and spaced apart from said toning member, to remove excess toner from said first major surface of said recording medium;

a first peripheral member disposed on a side of said knife edge opposite to said toning member, said first peripheral member being spaced apart from said knife edge, defining a first major fluid channel therebetween;

a second peripheral member spaced apart from said adjacent member, defining a second major fluid channel therebetween; and a bifurcation means, disposed between said knife edge and said toning member, for separating a fluid flow, said knife edge and said bifurcation means defining a first fluid return channel therebetween with said toning member and said bifurcation means defining a second fluid return channel therebetween.

2. The toning shoe as recited in claim 1 wherein said toning surface is positioned to be spaced apart from said first major surface a distance, with a width of said second fluid return channel being less than said distance to prevent accumulation of toner on said toning surface during operation.

3. The toning shoe as recited in claim 1 further including a means for placing said first and second major fluid channels in fluid communication with each other.

4. A toner system for applying toner to the surface of a recording medium containing a latent electrostatic image comprising:

a toning shoe including a toning member with a surface in fluid communication with a recording medium having a first major surface bearing a latent image and an opposed second major surface, said toning surface facing the first major surface and including a bifurcation means for separating a fluid flow, said bifurcation means defining a first fluid return channel and a second fluid return channel; said toning shoe including a major fluid channel and an applicator port;

a cross member spaced apart from said toning surface, said cross member extending across said applicator to position said recording medium a predefined distance from said toning surface; and air supply means for directing air into said toning shoe, wherein air exits said major fluid channel to confine toner to said toning surface, toner exits said applicator port to tone said first major surface with excess toner moving adjacent to said toning surface to enter said second fluid return channel and air enters through said first fluid return channel.

5. The system as recited in claim 4 wherein said toning member is spaced apart from said first major surface a distance, with a width of said second fluid return channel being less than said distance to prevent accumulation of toner on said toning surface during operation.

6. The system as recited in claim 5 further including a vise means, connected to said cross member, for providing a variable clamping force to said recording medium.

7. The system as recited in claim 6 wherein said vise means provides said clamping force in response to fluid pressures.

8. The system as recited in claim 6 wherein said vise means includes an elastic bladder.

9. The system as recited in claim 6 wherein the vise means includes a metal surface facing the toning surface to conform to the profile of the toning surface.

10. The system as recited in claim 7 wherein the vise means includes a plurality of metal sheets facing the toning surface to conform to the profile of the toning surface.

11. The system as recited in claim 8 wherein said bladder is formed from an elastic material selected from the group consisting of neoprene or buna-N and includes an electrically grounded electrode facing said toning surface.

* * * * *